US008479680B2

(12) United States Patent
Takahashi et al.

(10) Patent No.: US 8,479,680 B2
(45) Date of Patent: Jul. 9, 2013

(54) ENGINE BLOCK COATING SYSTEM

(75) Inventors: Hideo Takahashi, Yokohama (JP); Takashi Ogino, Yokohama (JP); Kazuhiro Kougo, Yokohama (JP); Kiyokazu Sugiyama, Chigasaki (JP)

(73) Assignee: Nissan Motor Co., Ltd., Yokohama (JP)

( * ) Notice: Subject to any disclaimer, the term of this patent is extended or adjusted under 35 U.S.C. 154(b) by 305 days.

(21) Appl. No.: 12/886,223

(22) Filed: Sep. 20, 2010

(65) Prior Publication Data

US 2011/0005457 A1 Jan. 13, 2011

Related U.S. Application Data

(62) Division of application No. 11/340,416, filed on Jan. 26, 2006, now Pat. No. 7,823,284.

(30) Foreign Application Priority Data

Jan. 28, 2005 (JP) ..... 2005-021686
Dec. 1, 2005 (JP) ..... 2005-348463

(51) Int. Cl.
*B05C 5/00* (2006.01)
*B05D 7/22* (2006.01)

(52) U.S. Cl.
USPC ..... 118/317; 427/236

(58) Field of Classification Search
None
See application file for complete search history.

(56) References Cited

U.S. PATENT DOCUMENTS

| | | | | |
|---|---|---|---|---|
| 3,117,726 | A * | 1/1964 | Schoberg | 239/291 |
| 4,857,367 | A | 8/1989 | Thorn et al. | |
| 5,363,821 | A | 11/1994 | Rao et al. | |
| 5,573,814 | A | 11/1996 | Donovan | |
| 6,395,090 | B1 | 5/2002 | Shepley et al. | |
| 6,719,847 | B2 | 4/2004 | Rice et al. | |
| 7,555,837 | B2 | 7/2009 | Sugiyama et al. | |
| 2001/0029886 | A1 * | 10/2001 | Keller | 118/504 |
| 2002/0172769 | A1 | 11/2002 | Herber et al. | |
| 2004/0132387 | A1 * | 7/2004 | Kruse | 451/51 |

FOREIGN PATENT DOCUMENTS

| | | |
|---|---|---|
| EP | 0 716 158 A1 | 6/1996 |
| JP | H06-065711 | 3/1994 |

* cited by examiner

*Primary Examiner* — Dah-Wei Yuan
*Assistant Examiner* — Charles Capozzi
(74) *Attorney, Agent, or Firm* — Global IP Counselors, LLP

(57) ABSTRACT

An engine block coating system for applying a coating to an engine block includes a work stand, a coating gun, and a first nozzle. The work stand supports the engine block. The coating gun discharges coating on an inner surface of a first cylinder bank. The first nozzle discharges gas from a second cylinder bank to a crankcase side of the first cylinder bank and the second cylinder bank such that the second cylinder bank is shielded from the coating. The coating gun and the first nozzle are arranged relative to each other such that gas discharged by the first nozzle is discharged toward the coating to alter a direction of the coating by the gas discharged by the first nozzle directly contacting the coating such that the coating would otherwise contact the cylinder bore of the second cylinder bank upon stopping discharge of the gas by the first nozzle.

17 Claims, 6 Drawing Sheets

ENGINE BLOCK COATING SYSTEM

CROSS-REFERENCE TO RELATED APPLICATIONS

This application is a divisional application of U.S. patent application Ser. No. 11/340,416 filed on Jan. 26, 2006. The entire disclosure of U.S. patent application Ser. No. 11/340,416 is hereby incorporated herein by reference.

This application claims priority to Japanese Patent Application No. 2005-021686, filed on Jan. 28, 2005, and to Japanese Patent Application No. 2005-348463, filed on Dec. 1, 2005. The entire disclosures of Japanese Patent Application No. 2005-021686 and Japanese Patent Application No. 2005-348463 are hereby incorporated herein by reference.

BACKGROUND

1. Field of the Invention

The present invention generally relates to a system for coating a cylinder bore of an engine block.

2. Background Information

An engine block may be designed to include a coating, e.g., a ferrous material, coated on the inner surface of the cylinder bore. Such a coating may allow engine designs having reduced overall weight of the engine block and enhanced abrasion resistant properties for inner surfaces of the cylinder bores. For example, a coating may be particularly useful for aluminum engine blocks.

It is desirable to prevent a coating from adhering to a lower portion of an adjacent cylinder bore. For example, if while spraying a coating on one cylinder bore, some amount of spray is directed to an adjacent cylinder bore, the spray in the adjacent cylinder bore will have a lower degree of adhesion. Thereafter, if the adjacent cylinder bore is coated, the coating in that cylinder bore will continue to have a low degree of adhesion to the cylinder bore. This may cause the coating in that cylinder bore to break free during engine operation, which may lead to poor engine performance or even engine failure.

One method to prevent a coating from adhering to a lower portion of the adjacent cylinder bore requires covering lower parts of the cylinder bore with a masking shield prior to spraying the cylinder bore with a coating. The masking shield protects the lower portion of the cylinder bore when the coating is formed on the inner surface of the engine cylinder bore. After spraying, the masking shield must be removed.

Removing masking shields is labor-intensive. Further, masking shields are consumable items that contribute to engine manufacturing expenses. In addition, since a coating may have formed a continuous layer connecting an inner surface of a cylinder bore to a masking shield, removal of a masking shield runs the risk of breaking and damaging the coating formed on the inner surface of the cylinder bore.

SUMMARY

Embodiments of the disclosure prevent or reduce adherence of a coating to a cylinder bore without using masking materials by protecting the lower portion of the cylinder bore with a gas gun. Embodiments of the disclosure may be particularly useful for forming a coating on the inner surface of the cylinder bores in one cylinder bank while protecting cylinder bores in an opposing cylinder bank, e.g., in a V-type engine.

In accordance with a first aspect, an engine block coating system for applying a coating to an engine block comprises a work stand, a coating gun, and a first gas nozzle. The work stand is configured to support the engine block. The coating gun is arranged relative to the work stand to discharge a coating material to form the coating on an inner surface of a cylinder bore of a first cylinder bank of the engine block. The first gas nozzle is arranged relative to the work stand such that gas is discharged by the first gas nozzle from within a cylinder bore of a second cylinder bank of the engine block to a crankcase side of the cylinder bore of the first cylinder bank and the cylinder bore of the second cylinder bank such that the cylinder bore of the second cylinder bank is shielded from the discharged coating material. In addition, the coating gun and the first gas nozzle are arranged relative to each other such that the gas discharged by the first gas nozzle is discharged toward the discharged coating material. Due to this arrangement, the gas discharged by the first gas nozzle directly alters a direction of the discharged coating material by the gas discharged by the first gas nozzle directly contacting the discharged coating material such that the discharged coating material would otherwise contact the cylinder bore of the second cylinder bank upon stopping discharge of the gas by the first gas nozzle.

Embodiments of the disclosure may provide one or more advantages. For example, since masking materials are reduced or not used, the process of removing the masking material from the engine block may be reduced or eliminated. This also helps to reduce manufacturing expenses by avoiding the use of consumable masking materials to which the spray material adheres. In addition, embodiments of the disclosure prevent damage to an applied coating on the inner surface of the cylinder bore during removal of a masking material.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents. Numerical symbols corresponding to the embodiments of the present invention are used for the sake of easier comprehension, but these numerical symbols do not limit the present invention.

Figure 1:
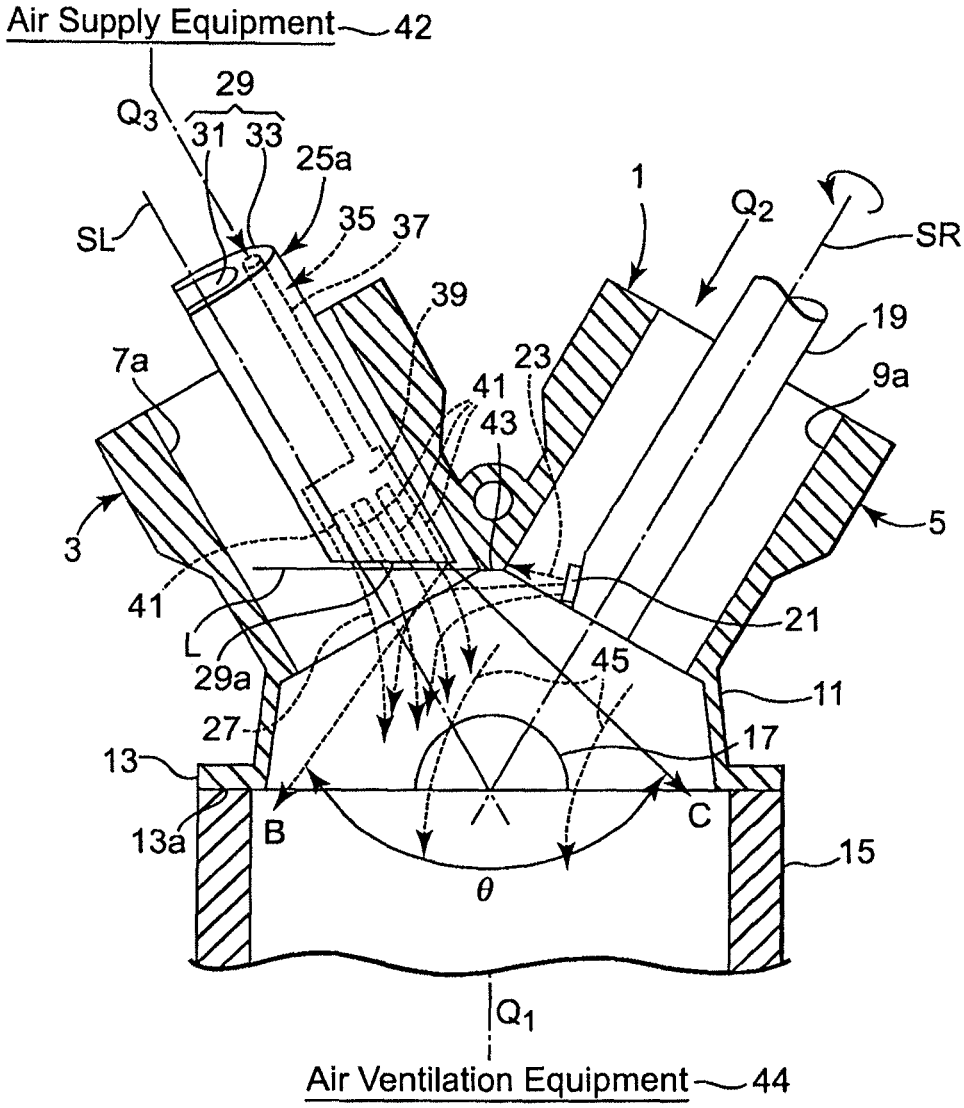
FIG. 1 is a cross-sectional view of A-A in FIG. 2 showing coating masking techniques in a first exemplary embodiment.
Figure 2:
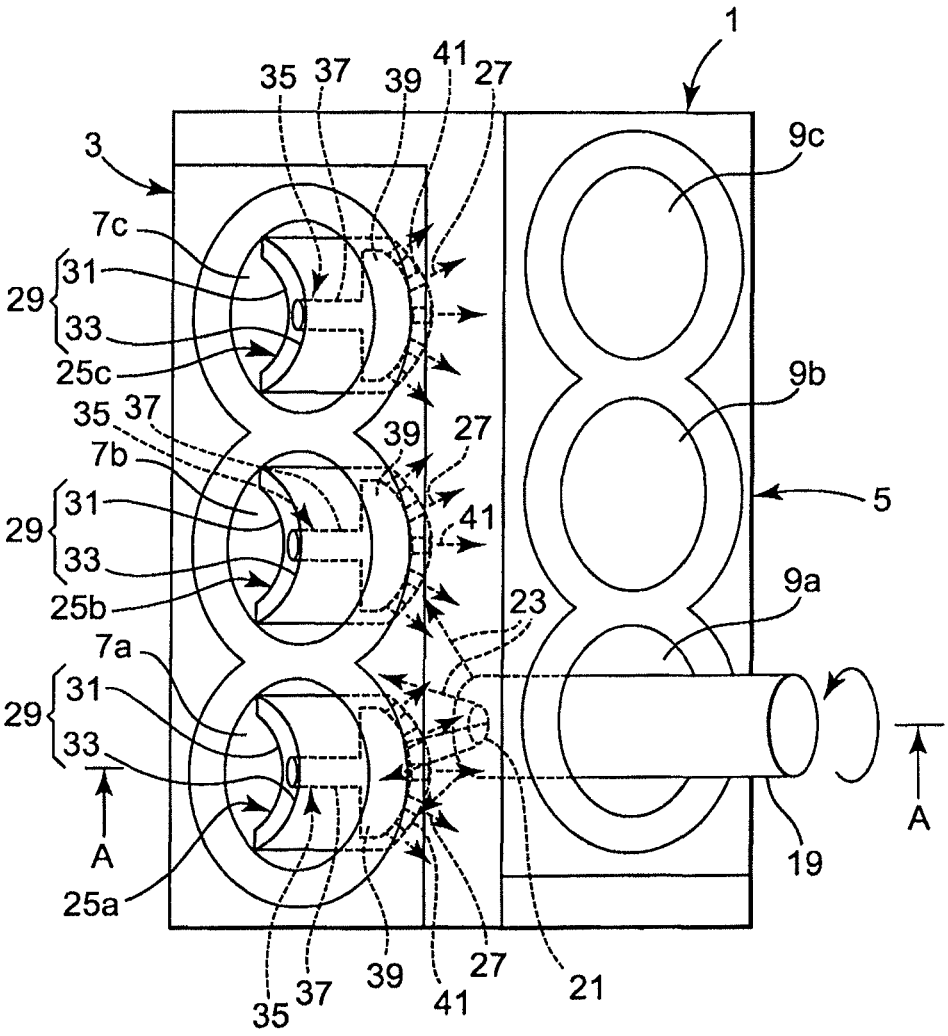
FIG. 2 is a plain view of the engine block 1 viewed from the side of the mounting surface in the first exemplary embodiment.

A first exemplary embodiment of coating masking techniques is shown in FIG. 1, which is a view of section A-A from FIG. 2. FIG. 2 is a side view of engine block 1 as viewed from the side of the mounting surface. In this example, the engine block 1 represents a V-type engine with the left and right banks 3 and 5, each bank having three cylinder bores, 7*a*, 7*b*, 7*c* and 9*a*, 9*b*, 9*c* respectively, arranged in straight lines toward the axial direction of the crankshaft (not shown).

The cylinder bores 7*a*, 7*b*, 7*c* forming the cylinder bank on the left bank 3 and the cylinder bores 9*a*, 9*b*, 9*c* forming the cylinder bank on the right bank 5 are arranged opposite to one another. Each of the cylinder bores 7*a*, 7*b*, 7*c* oppose each of the cylinder bores 9*a*, 9*b*, 9*c* and vice versa. The extensions of central axes SL of the cylinder bores 7*a*, 7*b*, 7*c* and SR of the cylinder bores 9*a*, 9*b*, 9*c* intersect with each other as viewed from the axial direction of the crankshaft, for example, the view shown in FIG. 1.

The engine block 1 may be designed to include a coating, e.g., a ferrous material, coated on the inner surface of the cylinder bore. For example, engine block 1 may be an aluminum engine block. Such a coating may enhance abrasion resistant properties for inner surfaces of the cylinder bores 7*a*, 7*b*, 7*c* and 9*a*, 9*b*, 9*c*.

The engine block 1, as shown in FIG. 1, includes crankcase 11 on the lower end of cylinder bores 7*a*, 7*b*, 7*c* and 9*a*, 9*b*, 9*c*. The oil pan rail 13*a* of flange 13, protruding to both sides of the crankcase 11, is fixed on the hollow center work stand 15 (means for supporting). The crank journal 17 rotationally supports the crankshaft (not shown).

To create a coating, a coating gun 19, as shown in FIG. 2, enters the cylinder bore 9*a* in one cylinder bank on the right bank 5, and the center of the spray gun is aligned with the central axis SR of the cylinder bore 9*a*. The spray gun 19 rotates about the central axis SR as it moves along the central axis SR, spraying a coating material 23 from the spray nozzle 21. In this manner, a coating gun 19 forms a coating on the inner surface of the cylinder bore 9*a*.

Prior to spraying a coating, to protect lower portions of the cylinder bores 9*a*, 9*b* and 9*c*, gas guns 25*a*, 25*b*, 25*c* are inserted into the cylinder bores 7*a*, 7*b* and 7*c*, respectively, each opposite to the cylinder bores 9*a*, 9*b* and 9*c*. A gas 27 is then discharged out of the gas guns 25*a*, 25*b*, 25*c*. For example, the gas 27 may consist of air.

Gas guns 25*a*, 25*b*, and 25*c* are substantially similar; however, the following description will only refer to gas gun 25*a*, and cylinder bores 9*a* and 7*a*. The gas gun 25*a* is arranged as the semi-circular shaped gun housing 29, which is located along the lines of the inner surface of cylinder bore 7*a* at the near side of the cylinder bore 9*a*. The gun housing 29 has an inner portion 31 and an outer portion 33. The gas nozzle 35 is fixed in the space between inner portion 31 and outer portion 33.

The gas nozzle 35 forms gas path 37, which includes an expansion space 39 prior to multiple outlets 41. The multiple outlets 41 are arranged along the lines of the semi-circular gun housing 29. In other words, the outlets 41 of the gas nozzle 35 form a semi-circle along the inner portion 31 of the cylinder bore at the near side of the cylinder bore 9*a*. Gas 27 is supplied from the gas supply equipment 42 to gas path 37.

In addition, the gun housing 29 is longer near the wall of the cylinder bore and shorter near the center of the cylinder bore. Thus, the tip 29*a* is wedge shaped, which is aligned with the gas outlets of nozzle 41. Similarly, the length of the multiple outlets of nozzle 41 is the longest on the side of the cylinder bore 9*a*. The outlet length gradually gets shorter at positions farther from 9*a*, the nozzle located on the left end in FIG. 1 being the shortest.

A coating is formed all over the cylinder bore 9*a* inner surface by inserting a coating gun 19 into the cylinder bore 9*a* on the right bank 5, rotating while advancing it in the direction of the axis, and jetting a coating material 23 from a coating nozzle 21 on its tip. Simultaneously, the gas ventilation equipment 44 suctions out the gas in the engine block 1 from the lower side of the work stand 15 and pulls clean gas 45 in.

As the coating gun 19 forms the coating, the gas guns 25*a*, 25*b*, 25*c* are inserted into the cylinder bores 7*a*, 7*b*, 7*c* on the left bank 3 respectively, opposite to the cylinder bore 9*a*, and the gas supplied from the gas supply equipment 42 is sprayed as the gas 27 from the tip of each outlet 41.

In FIG. 1, the gas 27 that sprays from each outlet 41 of the gas guns 25*a*, 25*b*, 25*c* are arranged between the right and left flange parts 13 in the crankcase, and directed towards a range of angles θ between arrows B and C. In other words, the direction of the gas spray of each outlet 41 on the gas nozzle 35 is the opening part on the opposite side of the cylinder bore in the crankcase that communicates with the cylinder bore.

At this point, as shown in FIG. 1, a coating gun 19 is located at the terminal end of the cylinder bore 9*a*, and a coating nozzle 21 is directed towards the engine block bulkhead 43. As a result, some of a coating material 23 that sprays from a coating nozzle 21 flows towards the opposing cylinder bore 7*a* and comes very close to entering the cylinder bore 7*a*. However, the gas 27 that discharges from the gas gun 25*a* alters the direction of this flow downward, thereby preventing or reducing a coating material 23 from adhering to the inner surface of the opposing cylinder bore 7*a*. Likewise, the gas 27 spraying from the gas guns 25*b*, 25*c* prevents a coating material 23 from adhering to the cylinder bores 7*b*, 7*c* adjacent to the cylinder bore 7*a*.

As shown in FIG. 1, the outlets of nozzle 41 are located near the opening on the side of the cylinder bore 7*a* where a coating material 23 may enter the cylinder bore 7*a* to prevent a coating from adhering to the cylinder bore 7*a*. In addition, the outlets 41 are located forming a semi-circular arc covering about half the inner surface of the cylinder bore 7*a* closest to the cylinder bore 9*a* that receives a coating. In particular the outlets of nozzle 41, are arranged in a half-circle such that each of the set of outlets is substantially equidistant from an interior surface the cylinder bore 7*a*. This arrangement enables the gas 27 that sprays from each outlet 41 to block the spray materials passing below the engine block bulkhead 43.

The gas gun 25*a* that is inserted into the cylinder bore 7*a* is located such that the tip 29*a* is behind line L. Line L is an extension of the straight line that connects the spray from nozzle 21 of a coating gun 19 to the end of the engine block bulkhead 43 between the cylinder bore 7*a* and 9*a*, which is on the upper side in FIG. 1. As such, gas gun 25*a* is substantially shielded from a coating material 23 by the engine block bulkhead 43. This prevents a coating material 23 from adhering to nozzle 41, which may prolong the use of the gas gun 25*a*. In contrast, if gas gun 25*a* projected beyond line L, some of a coating material 23 may adhere to the gas discharging mouth of the outlet 41 and reduce the functional life of gas gun 25*a*.

The direction of the gas discharging from each outlet is set such that the gas 27 and the ventilation gas 45 merge smoothly and flow downwards. Thus, the flow of the ventilation gas 45 is not disturbed much by gas 27, enabling the spraying process to be performed efficiently.

As described above, coating masking may be performed by discharging the gas from the same gas supply equipment 42 and inserting the gas guns 25*a*, 25*b* and 25*c* into cylinder bores 7*a*, 7*b* and 7*c* simultaneously. Thus, coating of cylinder bores 9*a*, 9*b* and 9*c* may be performed successively or simultaneously without allowing a coating to adhere to the cylinder bores 7*a*, 7*b* and 7*c* during the coating of any of cylinder bores 9*a*, 9*b* and 9*c*.

In some embodiments, when spraying the cylinder bore 9*a*, the gas 27 prevents a coating material 23 from adhering to the cylinder bore 7*b* and 7*c*. In such embodiments, the gas 27 may be sprayed only from the gas gun 25*a* rather than from each gas guns 25*a*, 25*b*, and 25*c* during the spraying of the cylinder bore 9*a*. When using the same gas supply source (gas supply equipment 42) for the gas guns 25*a*, 25*b*, 25*c*, a valve may be installed in the middle of the gas piping (not shown) to direct gas only to gas gun 25*a*.

In addition, coating masking may be performed for each of three cylinder bores 9*a*, 9*b*, 9*c* consecutively, simultaneously or two at a time. In each case, the gas guns 25*a*, 25*b* and 25*c* corresponding to the cylinder bores 7*a*, 7*b* and 7*c* that are adjacent to each of the cylinder bores 9*a*, 9*b*, 9*c* being sprayed should be activated. In some embodiments, all gas guns in cylinder bores opposing a cylinder bore being sprayed may be activated.

When a coating is formed on the cylinder bore 9*a*, the gas 27 is supplied because of concern over the entrance of a coating material 23 due to the shape of the opening on the crankcase 11 of the cylinder bores 7*a*, 7*b*, 7*c* in the cylinder bank opposing the cylinder bore 9*a* that opposes the opening of the cylinder bore 9*a*. However, the cylinder bores 9*a*, 9*b*, 9*c* are parallel with one another and their openings on the crankcase 11 side are not opposed; therefore, there is no risk of entry of a coating material 23 into cylinder bores 9*b* or 9*c*.

After forming a coating on the cylinder bores 9*a*, 9*b* and 9*c* on the right bank 5, a coating gun 19 forms a coating on the cylinder bores 7*a*, 7*b* and 7*c*. This can be performed the same way as described above, by inserting the gas guns 25*a*, 25*b* and 25*c* into the cylinder bores 9*a*, 9*b* and 9*c* to discharge the gas. This time, a coating from a coating gun 19 is prevented from adhering to the cylinder bores 9*a*, 9*b* and 9*c*.

In the first exemplary embodiment described above, the ventilation gas amount Q1 suctioned by the gas ventilation equipment 44 is larger than the gas flow amount Q3 that the ventilation gas amount Q2 supplies to the gas gun 25*a*. This allows the assured draining of a coating material 23 flowing to the crankcase 1 side out of the engine block 1.

As described above, in the first exemplary embodiment, when a coating is formed on the cylinder bore 9*a*, a coating does not adhere to the cylinder bores 7*a*, 7*b*, 7*c* by the gas 27 flowing to the cylinder bores 7*a*, 7*b*, 7*c*. If a coating is formed to the cylinder bore 9*a* without taking such measures, a coating will adhere to the cylinder bores 7*a*, 7*b*, 7*c*.

In this case, compared with the cylinder bore 9*a* that actually performs a coating masking, the cylinder bores 7*a*, 7*b*, 7*c* are arranged further from a coating gun 19. The degree of adhesion of a coating attached to the cylinder bores 7*a*, 7*b*, and 7*c* is lower than that of a coating adhered to the cylinder bore 9*a*, which is problematic. Thereafter, a coating is formed by inserting a coating gun 19 to each of these cylinder bores 7*a*, 7*b*, 7*c* in the same way as the cylinder bore 9*a*. However, the low degree of adhesion of a coating remains for cylinder bores 7*a*, 7*b*, 7*c*, and a stable a coating can not be obtained.

In this case, although unwanted coating can be taken off, the cylinder bore may, by design, have a rough surface from a shot peening process. Such a rough surface increases the degree of adhesion. As a result, it is difficult to completely remove undesirable coating.

Accordingly, as described in this embodiment, when a coating is formed on the cylinder bore 9*a*, it is possible to increase the degree of adhesion of a coating formed on the cylinder bores 7*a*, 7*b*, 7*c* later by preventing a coating from adhering to the cylinder bores 7*a*, 7*b*, 7*c* by flowing the gas 27 to the cylinder bores 7*a*, 7*b*, 7*c* in the opposing cylinder banks.

In addition, when a coating is formed on the cylinder bores 7*a*, 7*b*, 7*c* after forming a coating on the cylinder bores 9*a*, 9*b*, 9*c*, one can stabilize a coating and also facilitate the subsequent washing of the cylinder bores 9*a*, 9*b*, 9*c* by preventing a coating from adhering to the cylinder bores 9*a*, 9*b*, 9*c* on which a coating has been already formed by flowing gas to the side of the cylinder bores 9*a*, 9*b*, 9*c*.

SECOND EMBODIMENT

Figure 3:
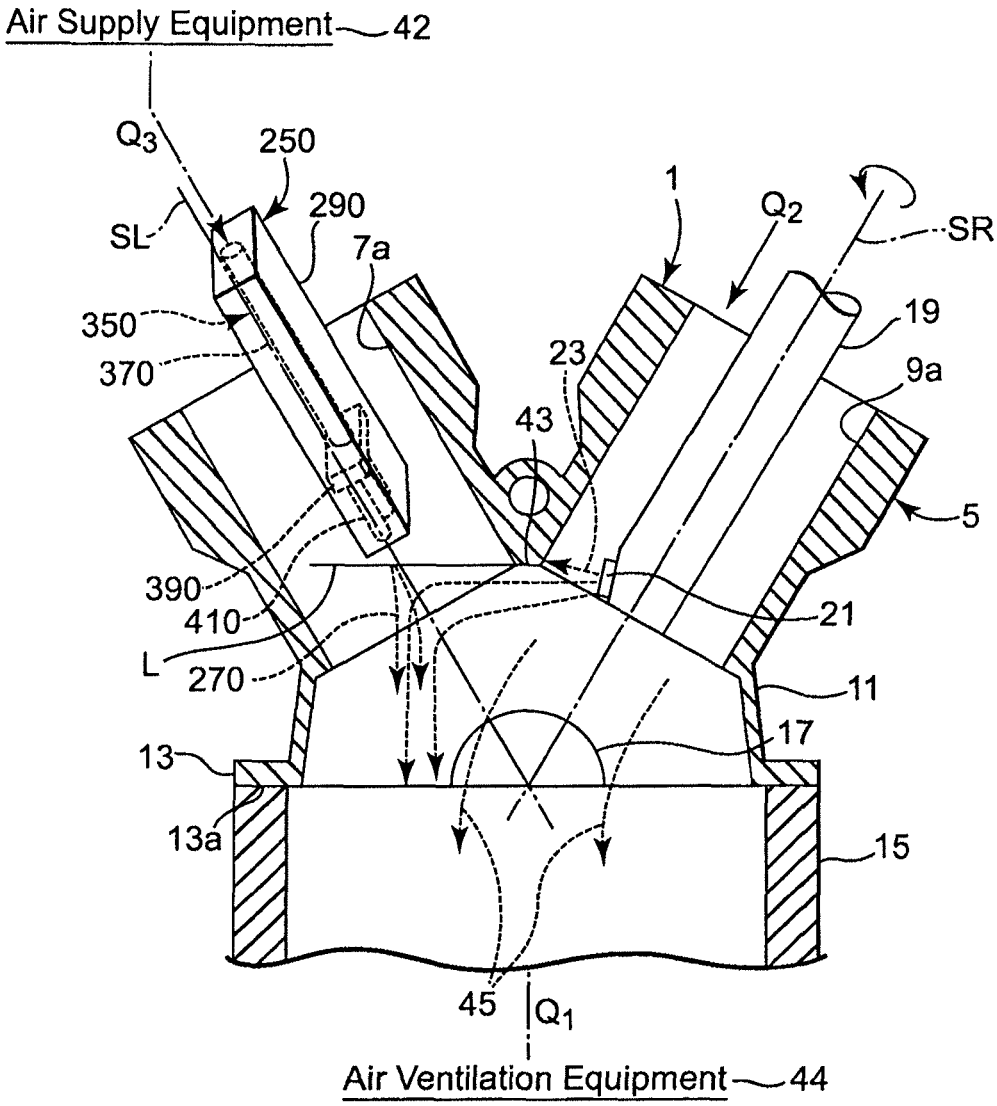
FIG. 3 is a cross-sectional view corresponding to FIG. 1 showing coating masking techniques in a second exemplary embodiment.

FIG. 3 is a cross-sectional view corresponding to FIG. 1 showing coating masking techniques in the second exemplary embodiment of the invention. In this embodiment a gas gun 250 is used instead of the gas guns 25*a*, 25*b* and 25*c* described in FIG. 1. Except for structure related to the gas gun 250, the structure and notations for members are the same as that in FIG. 1.

The gas gun 250 in the second exemplary embodiment has a gun housing 290 as a housing having a hollow rectangular shape. Inside the housing, the gas nozzle 350 is provided on the gas path 370 located on the side of rear anchor. The gas path 370 includes an expansion space 390 prior to outlets 410. Multiple outlets 410 on the side of rear anchor communicate with the expansion space 390.

As in the first exemplary embodiment, the direction of the gas spray of each outlet 410 on the gas nozzle 350 is inside the opening on the opposite side of the cylinder bore in the crankcase 11. The flow of the discharging gas 270 and that of the ventilation gas 45 merge smoothly and head downwards, the flow of the ventilation gas 45 is not greatly disturbed, and the spraying process may be performed efficiently.

In addition, as in the first exemplary embodiment, the tip of the gun housing 290, or the gas spray of each outlet 410 of the gas gun 250, is located on the side in the direction of gas discharging. Thus it is shown on the upper side in FIG. 3, located behind line L such that gas nozzle 350 is shielded from a coating material 23 by the engine block bulkhead 43. Here again, a coating material 23 maybe completely prevented from adhering to the gas spray of the nozzle 410. Consequently, equipment cost can be reduced by the prolonged use of the gas gun 250.

In this second exemplary embodiment, a coating gun 19 is located at the terminal end of the cylinder bore 9*a*, and outlet 21 is directed towards the engine block bulkhead 43. In this condition, a part of the spray material 23 from outlet 21 sprays towards the opposing cylinder bore 7*a* and comes close to entering it. However, the gas 270 that sprays from the gas gun 250 rectifies this flow downwards. As a result, a coating material 23 that sprays from outlet 21 is prevented from adhering to the inner surface of the opposing cylinder bores 7*a*, 7*b*, and 7*c*.

According to the second exemplary embodiment, since the gun housing 290 has a rectangular shape, the whole shape of the gas gun 250 is simplified as compared with the first exemplary embodiment.

In addition, as shown in FIG. 3, the multiple outlets 410 may be formed by slanting some outlets 410 toward the outside rather than forming all the outlets parallel to the central axis of the cylinder bore. This can be easily applied to various engine blocks with different diameters, rendering it versatile.

THIRD EMBODIMENT

Figure 4:
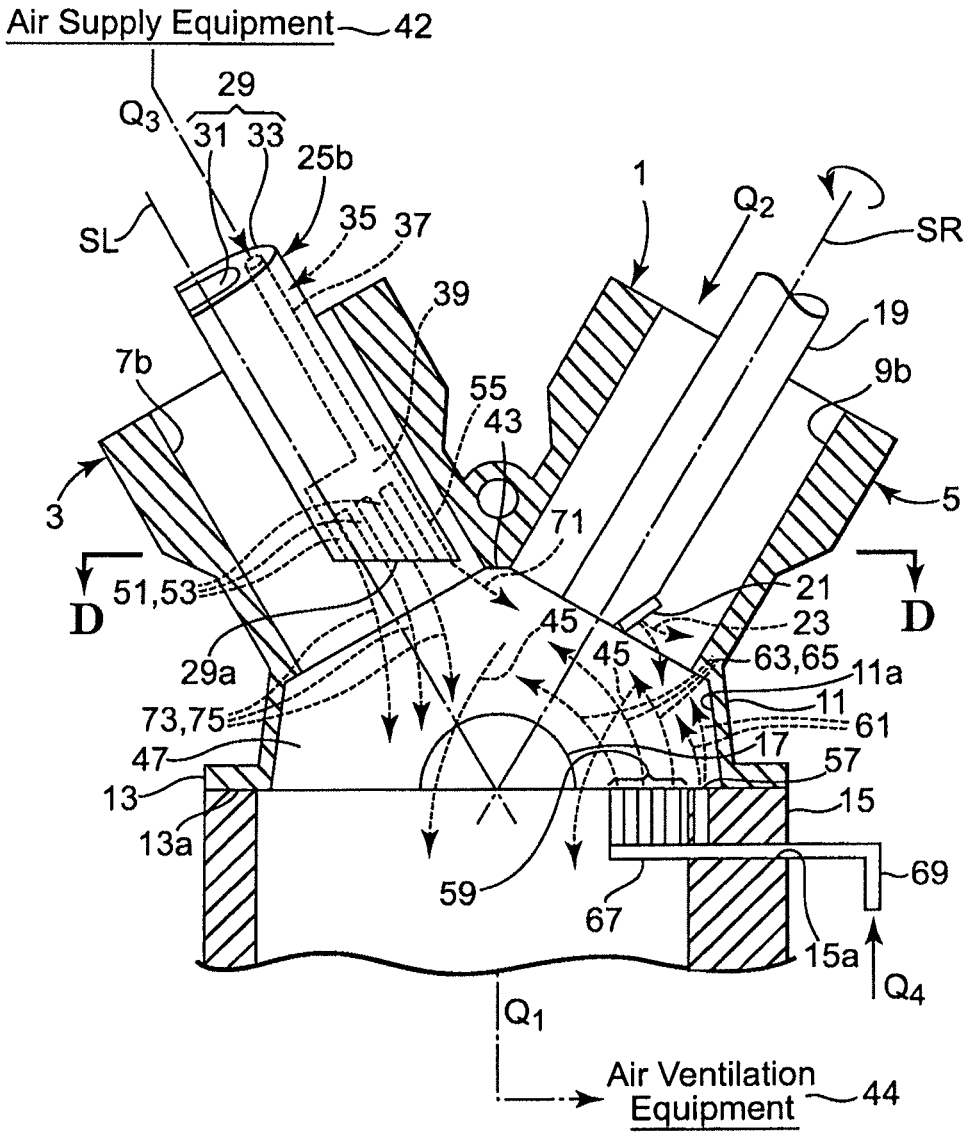
FIG. 4 is a cross-sectional view corresponding to FIG. 1 showing coating masking techniques in a third exemplary embodiment.
Figure 5:
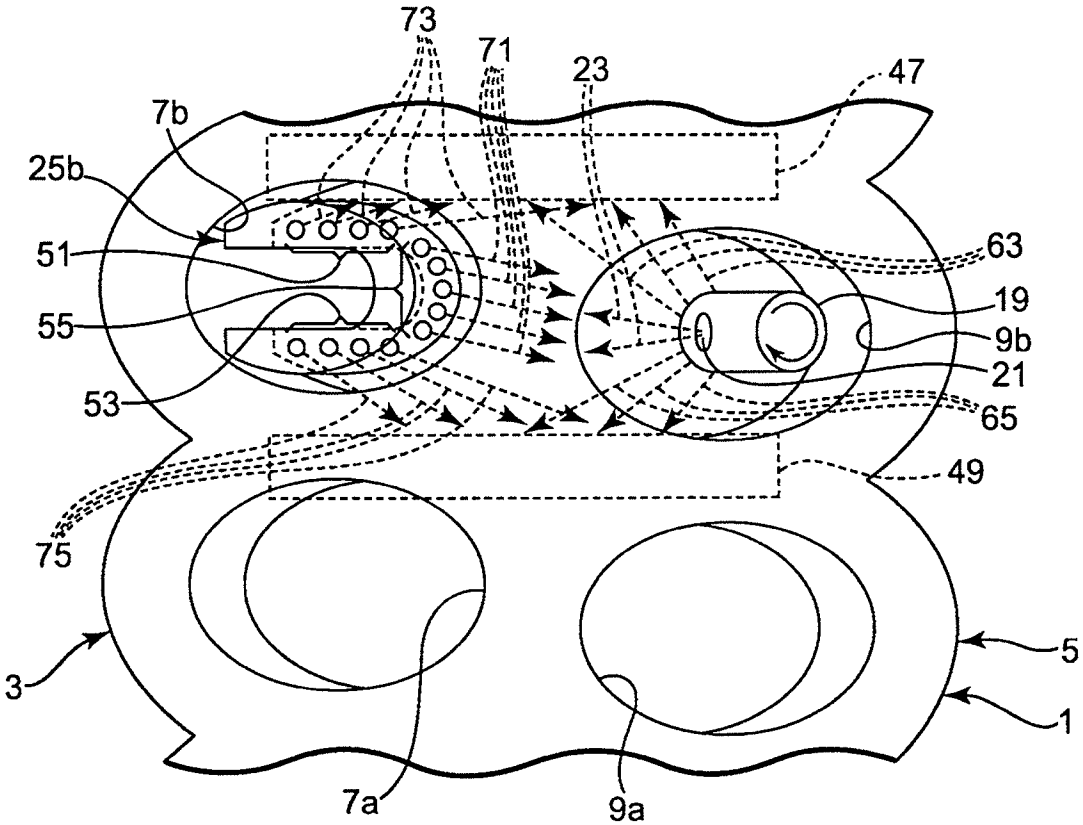
FIG. 5 is a cross-sectional view of D-D in FIG. 4.

FIG. 4 is a cross-sectional view corresponding to the FIG. 1, showing the coating masking method of the third exemplary embodiment. FIG. 5 is a cross-sectional view of D-D in FIG. 4. In FIG. 4 and FIG. 5, the same symbols are allocated to the same part or corresponding part of each component in FIG. 1 and FIG. 2. Also FIG. 4 and FIG. 5 show an example of forming a coating on the cylinder bore 9*b*, wherein the gas gun 25*b* is inserted into the cylinder bore 7*b* opposing the cylinder bore 9*b*.

The gas gun 25*b* in this embodiment has basically the same structure as that shown in FIG. 1. As shown in FIG. 5, it also includes the crank journal wall oriented nozzles 51 and 53 that are directed to the crank journal walls 47 and 49 situated in the upper and the lower parts in FIG. 5 respectively. Furthermore the third exemplary embodiment includes the cylinder bore oriented nozzle 55 directed to the cylinder bore 9*b*. The crank journal walls 47 and 49 comprise the crank journal 17 that rotationally supports the crankshaft (not shown).

The multiple crank journal oriented outlets of nozzles 51 and 53 (four outlets in this embodiment) are arranged along the horizontal direction in FIG. 5 respectively. These nozzles are oriented to the lower portion of the cylinder bore of the crank journal walls 47 and 49 where a coating can easily adhere.

The multiple cylinder bore oriented outlets of nozzle 55 (five outlets in this embodiment) are arranged along the circular arc shape of gun housing 29 and are directed to the opening of crankcase 11 of the cylinder bore 9*b*. In particular, the outlets of nozzle 55 are arranged in a half-circle such that each of the set of outlets is substantially equidistant from an interior surface of the cylinder bore 7*b*.

The outer gas nozzles 57 and 59 are arranged on the work stand 15 that is located downward of the cylinder bore 9*b* on which a coating is formed. These nozzles are gas discharging nozzles that spray gaseous gas upward in FIG. 4.

The outer gas nozzle 57 sprays the gas 61 toward the cylinder bore 9*b* along the inner wall 11*a* of the crankcase 11. It is formed so as to open from within the wall of the work stand 15 to within the crankcase 11.

The multiple gas outlets of nozzle 59 (three outlets in this embodiment) are arranged inside of the work stand 15 along the horizontal direction in FIG. 4 and discharge the gas 63 and 65 toward the crank journal walls 47 and 49 shown in the FIG. 5. These multiple outer gas outlets of nozzle 59 are arranged on the pipes extending in the perpendicular direction, and the lower end of the nozzle is communicated with the pipe 67 extending to the horizontal direction.

The gas supply pipe 67 is connected to the continuous hole 15*a*, adjacent to the lower end of the outer gas nozzle 57. The outside of the continuous hole 15*a* also connects with the gas supply piping 69. The gas is supplied from a gas source (not shown).

The outer gas nozzle 59 may be oriented to focus gas on both of the crank journal walls 47 and 49 simultaneously. In other embodiments, outer gas nozzle 59 may focus gas on only crank journal walls 49, and a different outer gas nozzle may focus gas on crank journal walls 47.

In the third exemplary embodiment, the gas 71 discharging from the cylinder bore oriented nozzle 55 prevents a coating material 23 from flowing to the opposing cylinder bore 7*b* and entering the cylinder bore 7*b* by altering the direction. Consequently, it can prevent some of a coating material 23 discharged from a coating nozzle 21 from adhering to the inner surface of the opposing cylinder bores 7*b* and 7*a*, 7*c*.

In addition, the gas 73 and 75 discharging from the crank journal wall oriented nozzles 51 and 53 flow to the crank journal walls 47 and 49 respectively. This prevents a coating material 23 from adhering to the crank journal walls 47 and 49.

Moreover, similarly to the previously described gas 73 and 75, the gas 63 and 65 discharging from the outer gas nozzle 59 flow to the crank journal walls 47 and 49 respectively. This prevents a coating material 23 from adhering to the crank journal walls 47 and 49.

Also, the gas 61 discharging from the outer gas nozzle 57 flows along the inner wall 11*a* of the crankcase 11. This prevents a coating material 23 from adhering to the inner wall 11*a* of the crankcase 11.

The speed and amount of the gas 61, 63, 65 discharging from the outer gas nozzles 57 and 59 are set such that a coating material 23 draining into the crankcase 11 does not flow back to the cylinder bore 9*b*.

In the third exemplary embodiment shown in FIG. 4, the ventilation gas amount Q1 is determined so that the gas amount Q2 entering the cylinder bore 9*b* exceeds the total gas amount Q3 supplied to the gas gun 25*a* and the gas amount Q4 supplied to the gas supply piping 69. This ensures a coating material 23 flowing out to the crankcase 11 is directed out of the engine block 1.

Since the outer gas nozzles 57 and 59 are arranged on the work stand 15 where the engine block 1 is installed, the gas 61, 63, and 65 can be discharged accurately to the inner surface 11*a* of the crankcase 11 and the crank journal wall 47 without adjusting the position of the outer gas nozzle 57 and 59, by installing the engine block 1 in the specified position on the work stand 15.

While the third exemplary embodiment includes the gas 61, 63, and 65 sprayed on the inner wall 11*a* of the crankcase 11 and the crank journal walls 47 and 49 to prevent adhesion of the coating, it is not always necessary to prevent adhesion of the coating on inner wall 11*a* of the crankcase 11 and the crank journal walls 47 and 49. For example, even if some of a coating material 23 adheres to the inner wall 11*a* of the crankcase 11 and the crank journal walls 47 and 49, the degree of adhesion of a coating to the inner wall 11*a* of the crankcase 11 and the crank journal walls 47 and 49 is lower than that to the cylinder bore 9*a*. The distance between a coating gun 19 and the inner wall 11*a* of the crankcase 11 and the crank journal walls 47, 49 is greater than that between a coating gun 19 and the cylinder bore 9*a*. Furthermore, inner wall 11*a* of the crankcase 11 and the crank journal walls 47, 49 are not generally textured. Also, the inner wall 11*a* of the crankcase 11 and the crank journal walls 47, 49 are not processed after cast molding as cylinder bores, and an oxide film remains, resulting in an even lower level of adhesion. For all of these reasons, a coating adhering to the inner surface 11*a* of the crankcase 11 and the crank journal walls 47, 49 can be removed, e.g., by subsequent washing.

FOURTH EMBODIMENT

Figure 6:
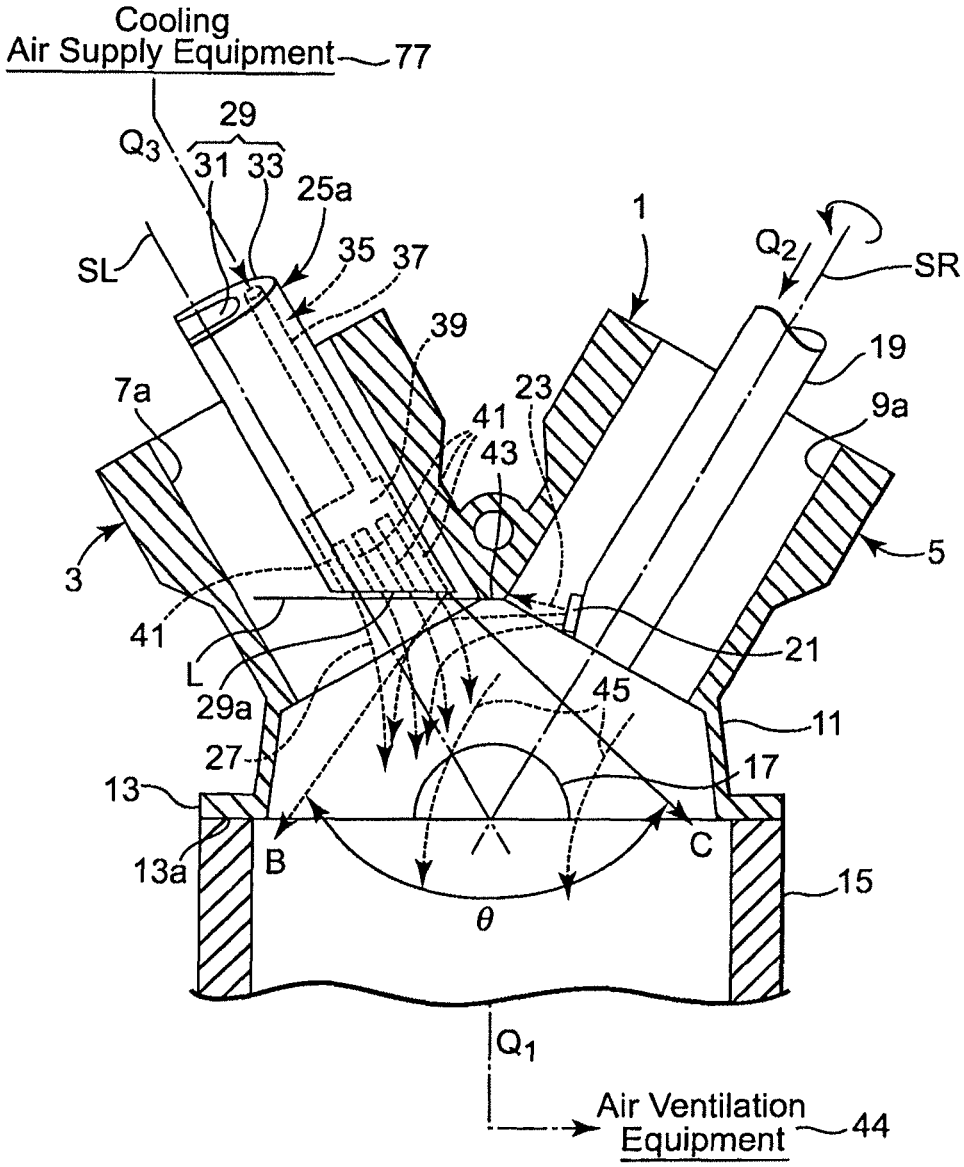
FIG. 6 is a cross-sectional view similar to FIG. 1, showing coating masking techniques in a fourth exemplary embodiment.

FIG. 6 is a cross-sectional view, showing the coating masking method of the engine block in the fourth exemplary embodiment of the invention. In FIG. 6, the same symbols are allocated to the same part or corresponding part of each component in FIG. 1.

The gas gun 25*a* in this embodiment has basically the same structure as that shown in FIG. 1; however, the supply source that supplies gas to the gas gun 25*a* is cooling gas supply equipment 77 instead of the gas supply equipment 42 in FIG. 1, and the entire gas gun 25*a* or a portion thereof is insulated to reduce or prevent condensation.

As compared to previously described embodiments, the cooling gas supplied from the cooling gas supply equipment 77 further decreases the adhesion of a coating material 23 to the cylinder bore 7*a*, the crank journal walls 47 and 49, and the inner surface 11*a* of the crankcase 11.

Since the degree of adhesion of a coating decreases at low temperature, a coating adhering in this condition can be more easily removed by subsequent washing. For example, a coating temporally adhering to the cylinder bore 7*a* and the crank journal walls 47, 49 or the inner wall 11*a* of the crankcase 11 can be removed.

However, the cooling gas into the gas gun 25*a* may result in condensation and water drops. When water drops appear, these water drops flow out to the crankcase 11 side and this has adverse effects in forming a coating on the cylinder bore 9*a* due to the steam generated within the engine block 1. However, it is possible to prevent condensation on the outer wall surface of the gas gun 25*a* by insulating the entire gas gun 25*a*, including the gas nozzle 35 or a portion thereof.

Cooled gas may be used in conjunction with any of the described embodiments. For example, the gas 61, 63, 65 discharged from the outer gas nozzles 57, 59 may be substituted with cooling gas. In addition, the entire outer gas nozzles 57, 59 or a portion thereof may be insulated.

Various embodiments of the invention have been described. However, various modifications can be made within the spirit of the invention. For example, in each of the above described embodiments, a V-type engine was described. The invention can be applied to any engines and is particularly applicable to any arrangement including opposing cylinders. For example, an engine may include additional cylinder banks or other arrangement of cylinders. In such cases, opposing cylinders may be masked using the described techniques to prevent undesirable adhesion of the coating. Furthermore, the described embodiments may be readily adapted to mask additional portions of an engine block. In addition, in each of the above described embodiments, the operation of a coating gun 19 and the gas guns 25*a*, 25*b*, 25*c*, and 250 may be automated with a robotic mechanism, be carried out by manual operation of workers, or by a combination thereof. These and other embodiments are within the scope of the following claims.

What is claimed is:

1. An engine block coating system for applying a coating to an engine block comprising:

a work stand configured to support the engine block;

a coating gun arranged relative to the work stand to discharge a coating material to form a coating on an inner surface of a cylinder bore of a first cylinder bank of the engine block; and a first gas nozzle arranged relative to the work stand such that gas is discharged by the first gas nozzle from within a cylinder bore of a second cylinder bank of the engine block to a crankcase side of the cylinder bores of the first and second cylinder banks such that the cylinder bore of the second cylinder bank is shielded from the discharged coating material by the gas discharged by the first gas nozzle, the coating gun and the first gas nozzle being arranged relative to each other such that the gas discharged by the first gas nozzle is discharged toward the discharged coating material, with the gas discharged by the first gas nozzle directly altering a direction of the discharged coating material by the gas discharged by the first gas nozzle directly contacting the discharged coating material such that the discharged coating material would otherwise contact the cylinder bore of the second cylinder bank upon stopping discharge of the gas by the first gas nozzle.

2. The engine block coating system of claim 1, wherein the first gas nozzle is arranged relative to the work stand to be located in a side of the cylinder bore of the second cylinder bank that is closest to the cylinder bore of the first cylinder bank.

3. The engine block coating system of claim 1, wherein the coating gun has a coating nozzle that is arranged relative to the work stand to be positioned within the cylinder bore of the first cylinder bank near an end of the cylinder bore of the first cylinder bank that is closest to an intersection of a first central axis line of the cylinder bore of the first cylinder bank and a second central axis line of the cylinder bore of the second cylinder bank.

4. The engine block coating system of claim 1, wherein the first gas nozzle includes multiple outlets arranged in a half-circle such that the outlets are arranged to follow an inner surface of the cylinder bore of the second cylinder bank along a side of the cylinder bore of the second cylinder bank closest to the cylinder bore of the first cylinder bank when the engine block is supported on the work stand.

5. The engine block coating system of claim 1, wherein the first gas nozzle is positioned near an opening of the cylinder bore of the second cylinder bank on the crankcase side of the cylinder bore of the second cylinder bank when the engine block is supported on the work stand.

6. The engine block coating system of claim 1, wherein the first gas nozzle is positioned such that the first gas nozzle is shielded from the discharged coating material by an engine block bulkhead separating the first and second cylinder banks of the engine block when the engine block is supported on the work stand.

7. The engine block coating system of claim 1, wherein the first gas nozzle includes a first outlet creating a first gas flow that shields a crank journal wall of the engine block from the discharged coating material, and a second outlet creating a second gas flow that shields the cylinder bore of the second cylinder bank from the discharged coating material.

8. The engine block coating system of claim 1, wherein the first gas nozzle includes a set of nozzles with one nozzle from the set of nozzles being disposed in each cylinder bore in the second cylinder bank to shield the cylinder bores in the second cylinder bank from the discharged coating material when the engine block is supported on the work stand.

9. The engine block coating system of claim 1, further comprising a second gas nozzle arranged relative to the work stand such that gas discharged by the second gas nozzle shields an inner wall of a crankcase of the engine block from the discharged coating material.

10. The engine block coating system of claim 1, wherein the second gas nozzle also discharges gas to shield a crank journal wall of the engine block from the discharged coating material when the engine block is supported on the work stand.

11. The engine block coating system of claim 1, further comprising a gas cooler that supplies the gas to the first gas nozzle such that the gas is cooled to decrease adhesion of the discharged coating material to surfaces of the engine block outside the cylinder bore of the first cylinder bank.

12. The engine block coating system of claim 11, further comprising insulation covering a portion of the first gas nozzle to limit condensation on the first gas nozzle.

13. An engine block coating system comprising:

a work stand configured to support the engine block;

a coating gun arranged relative to the work stand to be disposed within a first cylinder bore of a first cylinder bank of the engine block to discharge a coating spray on an inner surface of the cylinder bore of the first cylinder bank; and a gas gun arranged relative to the work stand to be disposed within a second cylinder bore of a second cylinder bank of the engine block to discharge a gas spray in a direction that directly alters a direction of the coating spray from the coating gun by the gas spray directly intersecting with the coating spray such that a direction of the coating spray is altered by the gas spray from a direction that would otherwise contact the second cylinder bore of the second cylinder bank upon stopping discharge of the gas spray from the gas gun.

14. The engine block coating system of claim 13, wherein the gas gun is configured such that the gas spray forms an airflow wall between the first cylinder bore and the second cylinder bore when the engine block is supported on the work stand.

15. The engine block coating system of claim 13, wherein the gas gun includes a set of nozzles, with each of the set of nozzles arranged in a half-circle such that each of the set of nozzles is substantially equidistant from an interior surface of the second cylinder bore when the engine block is supported on the work stand.

16. The engine block coating system of claim 13, further comprising an outer gas nozzle that is separate from the gas gun and that is arranged relative to the work stand such that a gas spray discharged by the outer gas nozzle is directed toward the coating gun to shield an inner wall of a crankcase of the engine block from the coating spray when the engine block is supported on the work stand.

17. The engine block coating system of claim 13, wherein the gas gun is positioned such that a tip of the gas gun nearest the work stand is shielded from the coating spray by an engine block bulkhead separating the first and second cylinder banks of the engine block when the engine block is supported on the work stand.

* * * * *